United States Patent [19]

Temburg

[11] Patent Number: 4,750,240

[45] Date of Patent: Jun. 14, 1988

[54] APPARATUS FOR OPENING SERIALLY ARRANGED FIBER BALES

[75] Inventor: Josef Temburg, Jüchen, Fed. Rep. of Germany

[73] Assignee: Trützschler GmbH & Co. KG, Mönchengladbach, Fed. Rep. of Germany

[21] Appl. No.: 941,222

[22] Filed: Dec. 12, 1986

[30] Foreign Application Priority Data

Dec. 16, 1985 [DE] Fed. Rep. of Germany ..... 3544435

[51] Int. Cl.[4] ..... D01G 7/04

[52] U.S. Cl. ..... 19/80 R; 19/81

[58] Field of Search ..... 19/80 R, 81

[56] References Cited

U.S. PATENT DOCUMENTS 4,281,437 8/1981 Marx ..... 19/80 R
4,586,217 5/1986 Kranefeld et al. ..... 19/80 R

FOREIGN PATENT DOCUMENTS 0130369 1/1985 European Pat. Off. .
0454679 6/1968 Switzerland ..... 19/80 R
0838793 6/1960 United Kingdom .
0964353 7/1964 United Kingdom .
1152591 5/1969 United Kingdom .

*Primary Examiner*—Louis K. Rimrodt
*Attorney, Agent, or Firm*—Spencer & Frank

[57] ABSTRACT

A bale opener is arranged for travel along a series of fiber bales and has a detaching (opening) device for progressively removing and hurling away fiber tufts from top faces of the fiber bales. The detaching device includes a generally horizontally supported opening roller having a roller axis and equipped with detaching teeth and a grate urged against top faces of the bales. The grate is formed by a series of side-by-side arranged grate bars spaced from one another in a direction parallel to the roller axis. The teeth project between adjoining grate bars and penetrate into top faces of the bales. A first imaginary contour line, defining a plane with the roller axis, interconnects tips of axially adjacent teeth of the opening roller and a second imaginary contour line, defining a plane with the roller axis, lies in an underface of each grate bar and interconnects side-by-side arranged grate bars in a direction generally along the roller axis. At least one of the first and second contour lines extends at least in part non-parallel to the axis of the opening roller.

9 Claims, 3 Drawing Sheets

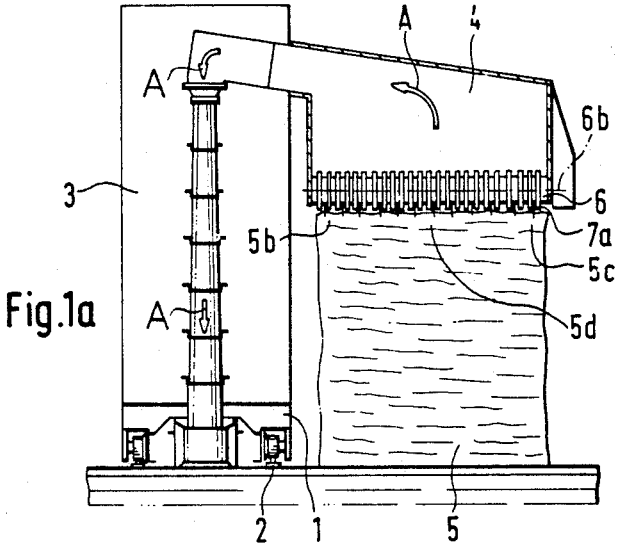
Fig.1a
Fig.1b
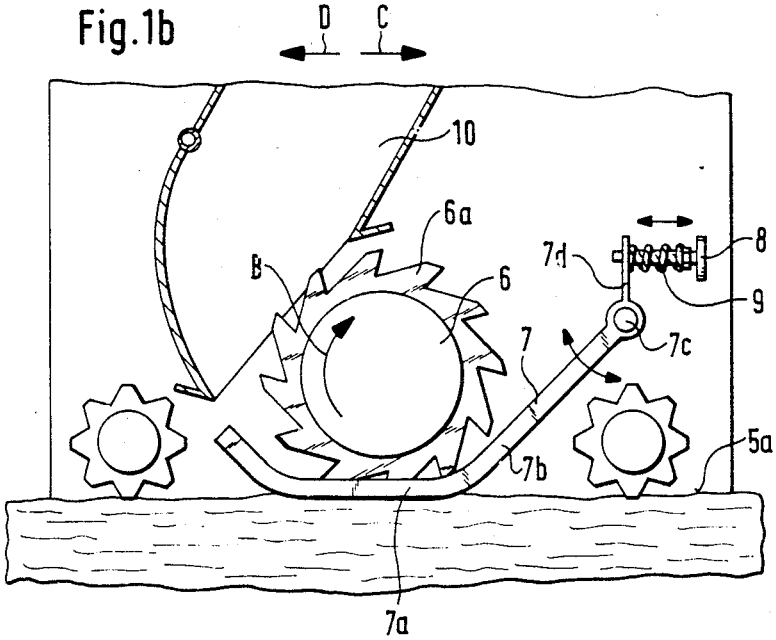

APPARATUS FOR OPENING SERIALLY ARRANGED FIBER BALES

BACKGROUND OF THE INVENTION

The invention relates to an apparatus for opening a plurality of fiber bales, particularly bales of cotton or chemical fibers or the like. The apparatus (bale opener) is of the type which has a rapidly rotating detaching (opening) device arranged for travel above a series of stationarily supported fiber bales. The pins or teeth of the rotary detachers (opening rollers) project through the grate bars of at least one grate and hurl the detached fiber tufts away from the bale surface.

In a known opening device of the above-outlined type an opening roller cooperating with a grate is provided wherein an imaginary contour line touching the tips of transversely (axially) consecutive teeth and an imaginary contour line tangential to the underface of transversely consecutive grate bars are linear and extend parallel to the axis of the opening roller. The grate bars are biased against the bale face with spring forces of identical magnitude. In such an arrangement in the lateral bale zones there is generated a higher working pressure (higher force) than in the mid-zone of the bale. In the lateral zone of the bale the fiber material may escape more easily in the lateral direction so that the bars press the fiber material in those lateral zones farther down than in the mid-zone of the bale. As a result of this phenomenon, the teeth of the opening roller—whether such teeth are directly attached to the cylindrical roller surface or whether they are part of toothed discs—penetrate only insufficiently—if at all—into the bale surface and thus detach fiber tufts only to a small degree. This results in a non-uniform opening (tuft removal) of the bale surface. It is a further disadvantage that the laterally extruded fiber material falls to the floor.

SUMMARY OF THE INVENTION

It is an object of the invention to provide an improved apparatus of the above-outlined type from which the discussed disadvantages are eliminated and which thus ensures a uniform fiber removal from the surface of the fiber bales.

This object and others to become apparent as the specification progresses, are accomplished by the invention, according to which, briefly stated, a bale opener is arranged for travel along a series of fiber bales and has a detaching (opening) device for progressively removing and hurling away fiber tufts from top faces of the fiber bales. The detaching device includes a generally horizontally supported opening roller having a roller axis and equipped with detaching teeth and a grate urged against top faces of the bales. The grate is formed by a series of side-by-side arranged grate bars spaced from one another in a direction parallel to the roller axis. The teeth project between adjoining grate bars and penetrate into top faces of the bales. A first imaginary contour line, defining a plane with the roller axis, interconnects tips of axially adjacent teeth of the opening roller and a second imaginary contour line, defining a plane with the roller axis, lies in an underface of each grate bar and interconnects side-by-side arranged grate bars in a direction generally along the roller axis. At least one of the first and second contour lines extends at least in part non-parallel to the axis of the opening roller.

By virtue of the fact that the imaginary contour line touching the tooth tips or pin tips of the opening roller or the underface of the grate bars has a varying distance as viewed along the length of the roller axis, the teeth or needles of the opening roller or the grate bars engaging the fiber bale surface are pressed with correspondingly different forces against the fiber bale. The contour line has a curved course, and the outer boundaries of the needles or pins or the grate bars are of stepped arrangement. Expediently, the contour line is curved in the lateral zones so that the downward pressure against the lateral bale zones is less than in the mid-zone of the bales.

According to a preferred embodiment of the invention, the contour line of the grate bars is outwardly convex, whereas the contour line of the axially consecutive teeth of the opening roller is linear. Thus, the contour line of the teeth extends parallel to the roller axis, while the grate bars are at a higher level in the lateral zones than in the mid-zone of the bales.

According to another preferred embodiment of the invention, the contour line of the teeth is outwardly concave, whereas the contour line of the grate bars is linear. The contour line of the grate bars thus extends parallel to the roller axis, while the diameter of the circle circumscribable about the teeth or pins of the opening roller is greater in the opposite end portions of the roller than in the mid-zone thereof.

According to the invention, a smaller working pressure is exerted in the lateral bale zones and further, lateral material ejection is reduced and also, the fiber tuft removal is rendered more uniform.

According to a further preferred embodiment of the invention, the bias of the grate bars in the lateral bale zone is smaller than in the mid-zone. This may be achieved by providing that the grate bars in the lateral zones press down on the material only by virtue of their weight, whereas the grate bars in the mid-zone are additionally spring-loaded or have a greater weight than the bars in the lateral zones. Or, in the alternative, the grate bars are spring-biased in the lateral zones to a lesser extent than those in the mid-zone. According to this embodiment, the contour line of the teeth or that of the grate bars may have a curved shape or both contour lines may be linear to extend parallel to the roller axis.

BRIEF DESCRIPTION OF THE DRAWING

FIG. 1*a* is a schematic sectional front elevational view of a preferred embodiment of the invention.

FIG. 1*b* is a sectional side elevational detail, on an enlarged scale, of the construction shown in FIG. 1*a*.

DESCRIPTION OF THE PREFERRED EMBODIMENTS

Figure 2:
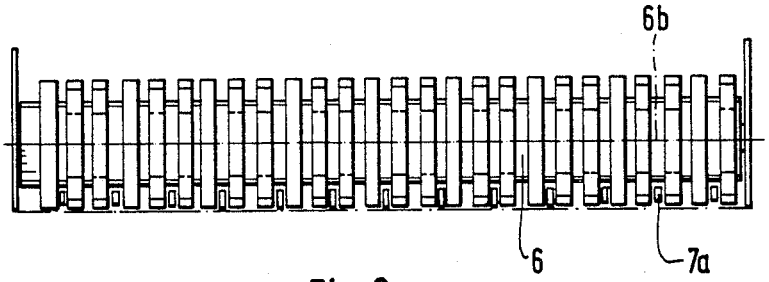
FIG. 2 is a front elevational view of components according to another preferred embodiment of the invention.

Turning to FIGS. 1*a* and 1*b*, there is schematically illustrated a bale opener which may be BLENDOMAT model manufactured by Trützschler GmbH & Co. KG, Mönchengladbach, Federal Republic of Germany. The bale opener advances on rails 2 and has a tower 3 on which there is mounted a laterally projecting opening assembly 4. Fiber bales 5 are placed on the floor alongside the rails 2. The opening assembly 4 comprises a rapidly rotating opening roller 6 which moves along the upper face of the serially arranged fiber bales as the bale opener travels on the rails 2. The arrow B indicates the direction of rotation of the opening roller 6, whicle the arrow C indicates the working direction during which fiber tufts are removed. The return run of the bale opener is indicated with the arrow D. The teeth 6*a* of the opening roller 6 project through a grate 7, formed of a plurality of grate bars 7*a* and bite into the fiber bale surface, tear out fiber tufts therefrom and hurl the tufts away from the fiber bale surface 5*a* into a duct 10 through which the fiber tufts are removed by suction as indicated by the arrow A.

In the structure according to FIGS. 1*a* and 1*b*, the contour line axially interconnecting the teeth 6*a* of the opening roller 6 and the contour line interconnecting the underface of the grate bars 7*a* of the grate 7 and extending along the roller axis 6b are at a constant distance from the axis 6*b* as viewed therealong. Stated differently, both contour lines are parallel to the roller axis 6*b*.

Each grate bar 7*a*, as illustrated in FIG. 1*b*, is secured by a holder arm 7*b* to a pivot 7*c* supported in a housing structure of the opening assembly 4. At the end of the holder arm 7*b* there is provided an attachment 7*d* which is biased by a compression spring 9 backed by a counter-support 8. In the lateral zones 5*b*, 5*c* the grate bars 7*a* are spring-biased to a lesser extent than in the mid-zone 5*d*. In this manner, the grate bars 7*a* in the lateral zones 5*b*, 5*c* exert a lesser pressure on the bale face 5*a* than in the mid-zone 5*d*.

Turning now to FIG. 2, in the embodiment shown therein, the contour line contacting the grate bars 7*a* is outwardly convex whereas the contour line touching the teeth 6*a* of the opening roller 6 is linear and extends parallel to the roller axis 6*b*. The opening roller 6 is oriented parallel to the bale face 5*a*. Expediently, the grate bars 7*a* constitute a substantially rigid construction so that the grate bars 7*a* are swingable in a vertical plane as a one-piece unit.

Figure 3:
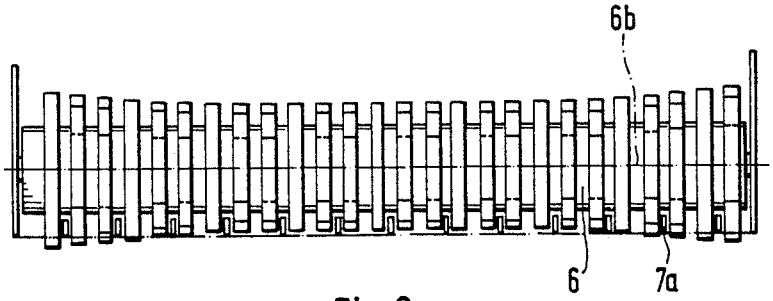
FIG. 3 is a front elevational view of components constituting still a further preferred embodiment of the invention.

Turning now to FIG. 3, in the embodiment shown therein the contour line connecting the teeth 6*a* is outwardly concave, while the contour line of the grate bars 7*a* is straight (linear) and extends parallel to the roller axis 6*b*. The grate bars 7*a* of the grate 7 are oriented parallel to the upper bale face.

Figure 4:
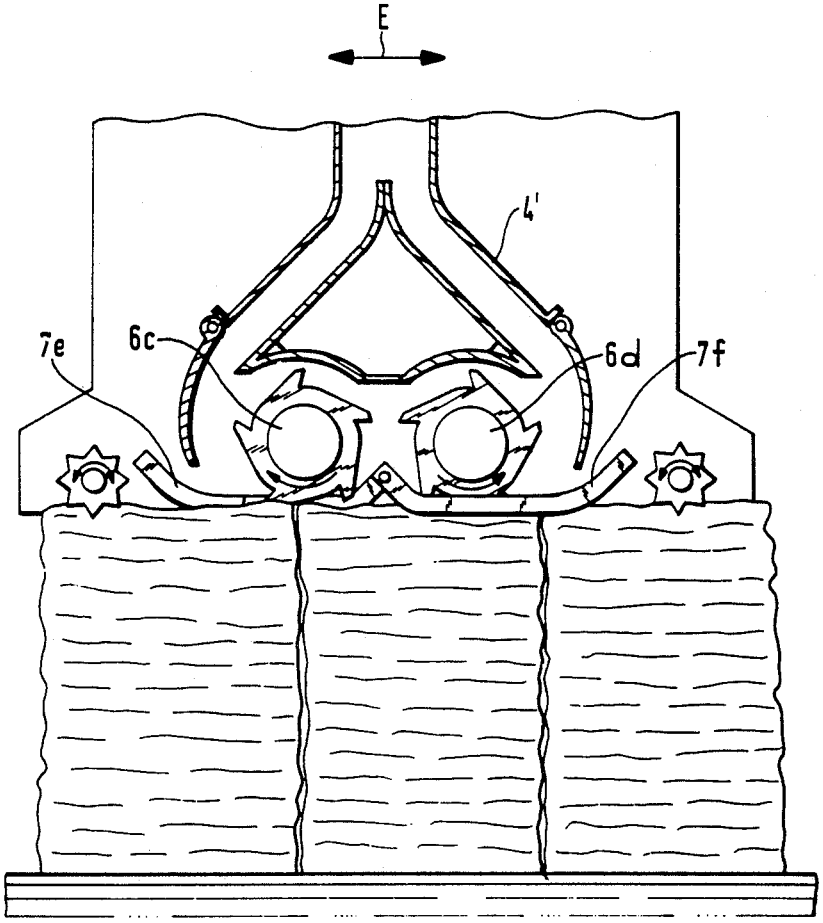
FIG. 4 is a schematic side elevational view of duplicated components according to FIGS. 2 or 3.

Turning now to FIG. 4, the opening assembly 4' is provided with two opening rollers 6*c* and 6*d* with which respective grate bars 7*e* and 7*f* are associated. The opening device removes fiber material in both directions as indicated by the arrow E.

The opening rollers 6*c*, 6*d* and the grate bars 7*e*, 7*f* may be configured in accordance with the embodiment shown in FIGS. 2 or 3.

The present disclosure relates to subject matter contained in Federal Republic of Germany Patent Application No. P 35 44 435.5 (filed Dec. 16th, 1985) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a bale opener arranged for travel along a series of fiber bales and having detaching means for progressively removing and hurling away fiber tufts from top faces of the fiber bales; said detaching means including a generally horizontally supported opening roller having a roller axis and equipped with detaching teeth and a grate urged against top faces of the bales; said grate being formed by a series of side-by-side arranged grate bars spaced from one another in a direction parallel to said roller axis; said teeth projecting between adjoining said grate bars and being arranged for penetrating into top faces of said bales; a first imaginary contour line defining a plane with said roller axis and interconnecting tips of axially adjacent teeth of said opening roller and a second imaginary contour line defining a plane with said roller axis, lying in an underface of each grate bar and interconnecting side-by-side arranged grate bars in a direction generally along said roller axis; the improvement wherein at least one of said first and second contour lines extends at least in part non-parallel to said axis of said opening roller.

2. A bale opener as defined in claim 1, wherein said opening roller has two opposite terminal length portions and a central length portion situated between the terminal length portions; and further wherein said one contour line is non-parallel to said roller axis in zones of said terminal length portions.

3. A bale opener as defined in claim 2, wherein said one contour line has a curvilinear course in said zones.

4. A bale opener as defined in claim 3, wherein said first contour line is linear and said second contour line is outwardly convex.

5. A bale opener as defined in claim 3, wherein said first contour line is outwardly concave and said second contour line is linear.

6. In a bale opener arranged for travel along a series of fiber bales and having detaching means for progressively removing and hurling away fiber tufts from top faces of the fiber bales; said detaching means including a generally horizontally supported opening roller having a roller axis and being equipped with detaching teeth and a grate pressable against top faces of the bales; said opening roller having two opposite terminal length portions and a central length portion flanked by the terminal length portions; said grate being formed by a series of side-by-side arranged grate bars spaced from one another in a direction parallel to said roller axis; the improvement comprising pressing means for urging grate bars situated in zones of said terminal length portions with a first force against top faces of the bales and for urging grate bars situated in a zone of said central length portion with a second force against top faces of the bales; said second force being greater than said first force.

7. A bale opener as defined in claim 6, said pressing means comprising separate springs connected to said grate bars for urging separately said grate bars against top faces of said bales with a spring force; the spring force of the springs associated with grate bars in the zones of said terminal length portions being smaller than the spring force of the springs associated with grate bars in the zone of said central length portion.

8. A bale opener as defined in claim 6, said pressing means comprising the weight of said grate bars and springs connected to grate bars situated in said zone of said central length portion for urging said grate bars situated in said zone of said central length portion with a force in addition to the weight thereof.

9. A bale opener as defined in claim 6, said pressing means comprising the weight of said grate bars; the grate bars situated in the zones of said terminal length portions being lighter than the grate bars situated in the zone of said central length portion.

* * * * *